United States Patent [19]

Gale et al.

[11] 3,996,901

[45] Dec. 14, 1976

[54] ROTARY PISTON MECHANISM

[76] Inventors: Richard A. Gale, 756 Jerusalem Road, Cohasset, Mass. 02025; Donald L. Kahl, 62 Pheasant Hill Drive, Scituate, Mass. 02066

[22] Filed: Feb. 26, 1974

[21] Appl. No.: 445,930

[52] U.S. Cl. ..... 123/8.45; 418/61 B

[51] Int. Cl.[2] ..... F02B 53/00

[58] Field of Search ..... 123/8.45; 418/54, 61 R, 418/61 B

[56] References Cited

UNITED STATES PATENTS

| | | | |
|---|---|---|---|
| 1,277,018 | 8/1918 | Wolfington | 418/61 B |
| 2,871,831 | 2/1959 | Patin | 418/61 B |
| 3,199,496 | 8/1965 | Kell | 418/61 B X |
| 3,285,189 | 11/1966 | Doyer | 418/54 |
| 3,301,228 | 1/1967 | Winans | 418/61 B X |
| 3,314,401 | 4/1967 | Kell | 123/8.45 |
| 3,364,907 | 1/1968 | Jeanson | 418/61 B |
| 3,441,007 | 4/1969 | Kwaak | 418/61 B X |
| 3,690,791 | 9/1972 | Dieter | 418/61 A |
| 3,771,501 | 11/1973 | DeDobo | 418/61 B X |

*Primary Examiner*—Carlton R. Croyle
*Assistant Examiner*—Michael Koczo, Jr.
*Attorney, Agent, or Firm*—Robert T. Dunn

[57] ABSTRACT

A rotary piston mechanism for internal combustion engines, fluid motors, pumps and the like has an outer body enclosing a chamber that is defined by three equal curvilinear walls that circumscribe the chamber axis and define an equilateral triangle in a plane perpendicular to the chamber axis, the walls being convex with respect to the axis, and a generally elongated rotor confined in the chamber of length equal to the span of the chamber along a bisector of any of the angles of the equilateral triangle defined by the chamber walls, the rotor being pivotally supported to rotate about a rotor axis which is parallel to the chamber axis and moves around the chamber axis over a closed path, the sense of rotation of the rotor on the rotor axis being opposite to the sense of rotation of the rotor axis around the chamber axis.

24 Claims, 33 Drawing Figures

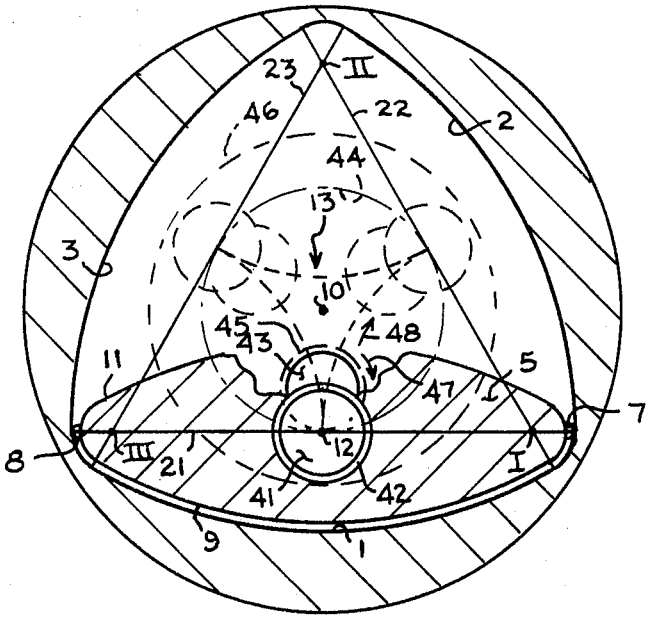
FIG 3
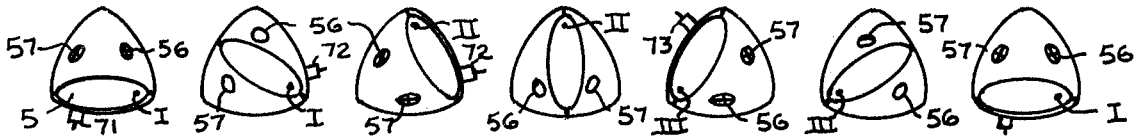
POWER EXHAUST & INTAKE — FIG 5a
EXPANSION & COMPRESSION — FIG 5b
POWER EXHAUST & INTAKE — FIG 5c
EXPANSION & COMPRESSION — FIG 5d
POWER EXHAUST & INTAKE — FIG 5e
EXPANSION & COMPRESSION — FIG 5f
POWER EXHAUST & INTAKE — FIG 5g
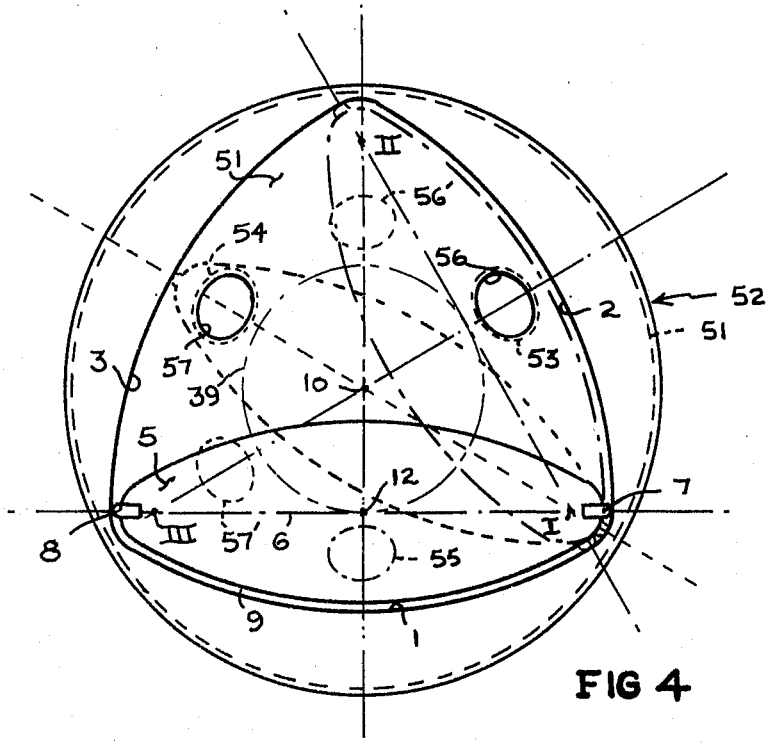
FIG 4

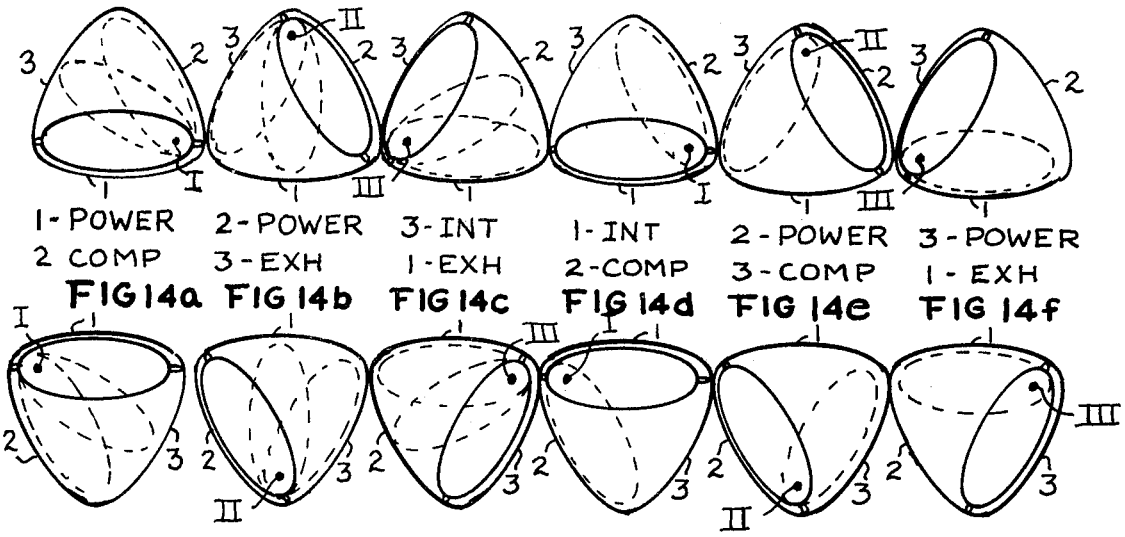
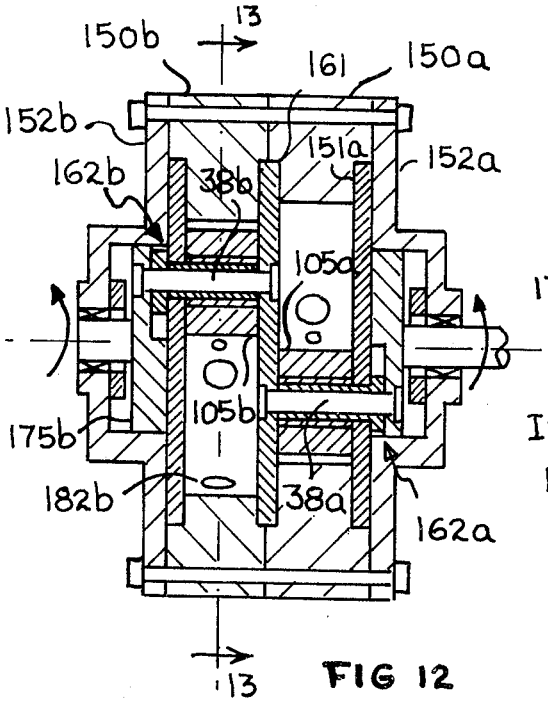
FIG 12
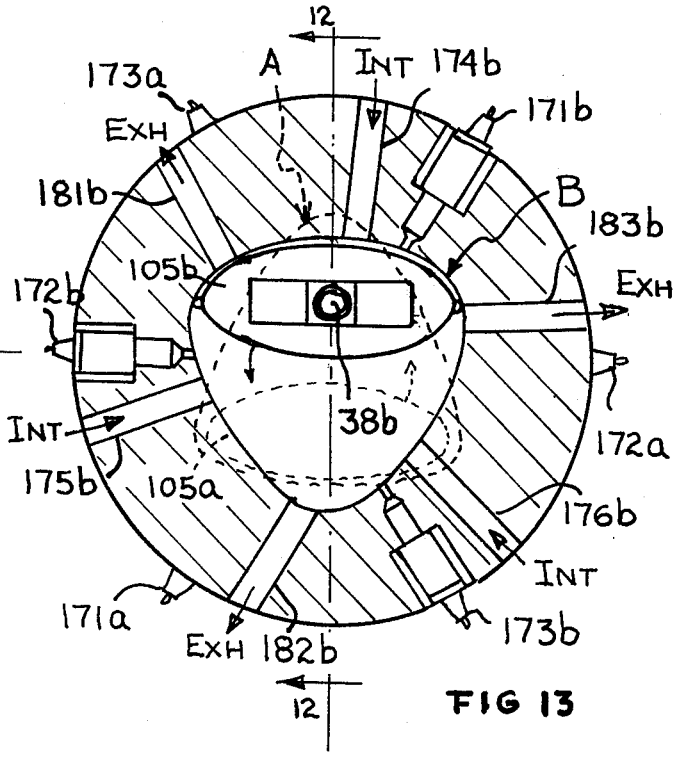
FIG 13

ROTARY PISTON MECHANISM

BACKGROUND OF THE INVENTION

This invention relates to rotary piston mechanisms and more particularly, to such a mechanism for internal combustion engines, fluid motors, pumps and the like, wherein a rotating piston or rotor captured in a chamber moves eccentrically with respect to an output or an input drive shaft eminating therefrom.

Heretofore, rotary piston mechanisms for use as fluid pumps have been proposed comprising a three tooth external gear and a two tooth internal gear rotating therein. The external gear is a chamber having three equal curvilinear walls which are concave with respect to the chamber axis and an elongated rotor that rotates on a rotor axle that moves in a circular orbit about the chamber axis. The rotor is of constant width and is rounded at the ends which fit into the corner spaces of the internal gear between the concave walls, and so fluid drawn into the chamber is forced by the rotor to these corners. In operation, the rotor contacts, rolls and slides along the three walls of the chamber in succession. This type of rotary piston mechanism has not been proposed for use in an internal combustion engine, because the rotor would have to seal against the chamber to hold high pressure gas and it would be very difficult to seal the rolling, sliding action of the rotor against the chamber walls.

Rotary piston internal combustion engines exemplified by the Wankel type engine have a generally triangular shaped rotor in an oblong chamber. The rotor is eccentrically driven in the chamber as it rides eccentrically about a fixed centrally located gear. Thus, the output drive shaft connected to the rotor is driven at the same rotation rate as the rotor. The three points of the rotor are equipped with sliding seals that engage the inner walls of the chamber and divide the chamber into three spaces, each bounded by each one of the faces of the rotor. During each complete revolution of the rotor, each of these spaces moves around the chamber increasing and decreasing in size to perform the four functions of intake, compression, power and exhaust as a gasoline, air mixture is drawn into the space, compressed, combusted to deliver power as it expands, and then, finally, exhausted. These functions are performed in all three of the spaces during each rotation of the rotor in the chamber and the power function is performed consecutively in the spaces always along the same portion of the walls of the chamber. The other functions are also performed consecutively in each of the spaces and each of them is also performed along a given portion of the walls of the chamber. Thus, the combustion and exhaust functions which inflict the greatest wear on the walls of the chamber, occur repeatedly along the same portions of the chamber walls and so, the effectiveness of the seals carried at each of the points of the rotor are inclined to degrade along these portions of the chamber walls.

It is intrinsic to the Wankel type engine and to any type rotary piston mechanism that uses a triangular shaped rotor which seals against the chamber walls at the points of the triangle, that the chamber be epitrochoidal with two symmetrical cusps. Hence, with respect to the axis of the chamber, the walls of the chamber are curvilinear and concave at all points except at the two cusps. At that point, the walls are generally convex with respect to the chamber axis, and so the seals must follow a concave wall which changes abruptly to convex at two points along a complete cycle of travel of the seal against the wall. Hence, the angle the seal subtends with the wall is not constant during the entire travel of the seal along the wall. In fact, that angle becomes exceedingly acute as it moves along the wall from a convex portion of the wall to a concave portion. The effectiveness of the seal where the angle is exceedingly acute, is diminished and the seals have a tendency to leak at such points.

SUMMARY OF THE INVENTION

In accordance with generic features of the present invention, a rotary piston mechanism for two cycle or four cycle internal combustion engines, fluid motors, fluid pumps and the like includes an outer body having a chamber formed within and a rotor confined in the chamber. The geometric center of the chamber lies along the chamber axis and the chamber has three equal curvilinear walls that circumscribe the axis and define an equilateral triangle in a plane perpendicular to the chamber axis. These walls at all points around the chamber axis are convex with respect to the axis. The rotor confined in the chamber is generally elongated and may be ovate in shape, or ellipsoidal. The length of the rotor is equal to the span of the chamber from wall to wall, perpendicular to the chamber axis, along the bisector of any angle of said equilateral triangle.

In operation, the rotor rotates continuously in one rotational direction about a rotor axis which is centrally located in the rotor, and this rotor axis moves continually around the chamber axis, the locus of the rotor axis with respect to the chamber axis, during operation being a closed path which defines a three cusp hypocycloid having its geometric center on the chamber axis. The rotor carries sealing vanes at the ends thereof which continually contact the three curvilinear walls of the chamber and the two longitudinal faces of the rotor close successively with the three walls six times with each rotation of the rotor on the rotor axis.

Various embodiments of the present invention disclose different mechanisms for providing the above defined motion or action of the rotor with respect to the chamber. For example, this motion can be achieved by carrying the rotor slideably on a key which rotates on its own axis and the key axis orbits the chamber axis on a circular orbit path. The motion can also be provided by a gear orbiting the chamber axis and carrying an eccentric axle on which the rotor is symmetrically mounted (concentric with the centrally located rotor axis). These are but two techniques and mechanisms for accomplishing the desired motion of the rotor with respect to the chamber that are described more fully herein.

The generic action or motion of the rotor with respect to the chamber and the general shapes of the chamber and the rotor, in accordance with the present invention, can be applied to an internal combustion engine, a fluid motor or a fluid pump and specific embodiments of the present invention are described herein for all of these applications. More particularly, operation of this rotary piston mechanism to perform as a two cycle internal combustion engine, a four cycle internal combustion engine, a fluid motor and a fluid pump are all described herein.

Accordingly, it is one object of the present invention to provide a rotary piston mechanism functioning as an internal combustion engine.

It is another object to provide a rotary piston internal combustion engine wherein at least some of the disadvantages of prior engines of this sort, such as the Wankel engine are avoided.

It is another object to provide a rotary piston internal combustion engine including seals carried on the rotor which seal against the chamber wall and wherein curvature of the wall is at all points therealong convex with respect to the chamber axis.

It is a further object in conjunction with the foregoing to provide such an engine wherein the seals engage the chamber walls at a substantially constant angle at all positions of the rotor.

It is another object to provide a rotary piston internal combustion engine wherein combustion occurs along all of the side walls of the chamber that circumscribe the chamber axis.

It is another object to provide a rotary piston internal combustion engine wherein the portion of the total chamber space into which gases expand is at least one-half of the total chamber space.

It is another object to provide a rotary piston internal combustion engine as in the foregoing object, wherein the compression ratio of the engine is determined substantially totally by ratio of rotor length to rotor width.

It is another object of the present invention to provide a two cycle rotary piston internal combustion engine.

It is another object to provide such a two cycle engine including intake and exhaust ports so located that all or some of these ports are not crossed by the seals as the rotor rotates.

It is a further object in conjunction with the above to provide such a two cycle rotary piston internal combustion engine wherein none of the intake or exhaust ports leading to the chamber are located in the walls that seal against the seals carried at the ends of the rotor.

It is a further object to provide such a two cycle engine including a rotating member that opens and closes ports to the chamber.

It is another object to provide a two cycle rotary piston internal combustion engine wherein the cycles of intake, compression, power and exhaust each occur at a plurality of different positions of the rotor during each cycle of rotation of the rotor on its own axis.

It is another object of the present invention to provide a four cycle rotary piston internal combustion engine wherein at least some of the disadvantages and limitations of prior engines of this sort, such as the Wankel engine, are avoided.

It is another object to provide a four cycle rotary piston internal combustion engine wherein the power cycle occurs at successive positions along the chamber wall.

It is another object to provide a four cycle rotary piston internal combustion engine wherein no more than two sliding seals are required at each end of the rotor to seal the rotor against chamber walls.

It is a further object to provide a four cycle rotary piston internal combustion engine wherein seals which extend from the ends of the rotor and seal against the walls of the chamber that circumscribe the chamber axis, engage the chamber walls at substantially a constant angle at all operating positions of the rotor in the chamber.

It is a further object to provide such a four cycle engine including two or more chambers and pistons in cascade so that the inertia of each piston is at least partially opposed by the inertia of another piston.

It is a further object in conjunction with the above to provide such a four cycle engine wherein at least one of the rotors delivers a power cycle to the output of the engine at all times.

It is another object of the present invention to provide the rotary piston mechanism functioning as a fluid motor.

It is a further object to provide a fluid motor including a chamber and rotor contained in the chamber wherein the maximum intake volume of the chamber is at least one-half of the total volume of the chamber.

It is another object to provide such a fluid motor wherein driving fluid enters a chamber and is exhausted from the chamber many times during each revolution of the rotor.

It is a further object in conjunction with the above to provide a fluid motor including a member rotating with the rotor which covers and uncovers intake and/or exhaust ports to the chamber and so controls the flow of fluid to the motor.

It is another object of the present invention to provide a rotary piston mechanism functioning as a fluid pump.

It is another object to provide a rotary piston pump wherein at least some of the disadvantages of prior pumps of this sort are avoided.

It is another object to provide a rotary piston pump having a two ended rotor which carries seals at each end thereof which slide along the chamber walls at all positions of rotation of the rotor.

It is a further object in conjunction with the foregoing to provide such a rotary piston pump wherein the seals engage the chamber walls at a substantially constant angle at all positions of the rotor.

It is a further object to provide a rotary piston pump as above wherein compression of fluid is in a space bounded by the length of the rotor and the length of a chamber wall and the seals at each end of the rotor.

It is a further object to provide such a pump including intake and exhaust ports so located that none are crossed by the seals carried at the ends of the rotor as it rotates.

It is a further object to provide such a rotary piston pump wherein a member rotating with the rotor opens and closes exhaust and/or intake ports to the chamber.

Other objects, features and advantages of the present invention and various embodiments thereof will be apparent from the following description of these features and embodiments taken in conjunction with the drawings included herein:

DESCRIPTION OF THE DRAWINGS

FIG. 3 shows another mechanism for positioning the rotor in the chamber where the rotor is centrally mounted on an axle that is carried eccentrically by the shaft of a gear orbiting around the chamber axis and so this mechanism positions the center of the rotor on the three cusp hypocycloid locus shown in FIGS. 1, 2 and 3;

FIG. 4 is a diagram showing a view along the chamber axis of the rotor, exhaust or intake ports, the stationary housing, exhaust or intake holes in an exhaust or intake disc that rotates on the chamber axis and carries the rotating rotor, the holes in the disc falling in registry with exhaust or intake ports in the housing to exhaust or intake gas or fluid from the portions of the chamber as required for the mechanism to perform as an internal combustion engine;

FIGS. 5*a* to 5*g* show the successive positions of the rotor in the chamber and the registration of the exhaust or intake holes in the rotating exhaust or intake disc with the exhaust or intake ports in the housing.

FIG. 12 is a cross section view taken as shown in FIG. 13 through the axis of a two rotor, four cycle internal combustion engine incorporating features of the present invention;

FIG. 13 is a cross section view of the engine shown in FIG. 12 taken transverse to the chamber axis showing the locations of the spark plugs and the locations of intake and exhaust ports for one of the chambers therein;

FIGS. 14*a* to 14*f* show one of the chambers of FIG. 12 and the successive positions of the rotor therein to perform the subcycles of the four cycles engine;

FIGS. 15*a* to 15*f* show the same successive positions of the other chamber of the four cycle engine shown in FIGS. 12 and 13;

DESCRIPTION OF THE EMBODIMENTS OF THE INVENTION BASIC ROTOR ACTION

Figure 1:
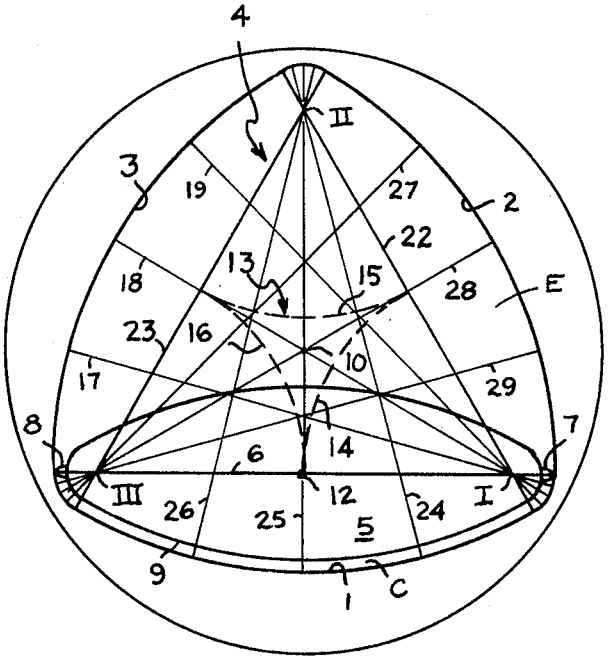
FIG. 1 is a diagram showing the chamber geometry, the rotor and successive positions of the rotor and the locus of the center of the rotor over one complete cycle of rotation of the rotor.

The configuration of the chamber and the rotor and the required positioning of the rotor in the chamber in accordance with the present invention is shown in FIG. 1. The shape of the chamber in a plane transverse to the axis of the chamber is defined by the three sides or walls 1, 2 and 3. The sides are curvilinear and are equal and at every point along all three sides they are convex with respect to the chamber axis 10 represented by the dot at the geometric center of the chamber. The chamber configuration shown in this figure defines an equilateral triangle 4 whose geometric center is at 10.

The elongated rotor 5 or rotary piston as it is sometimes called, is contained within the chamber. The longitudinal axis 6 of the rotor may coincide with one of the legs of the equilateral triangle at a position of the rotor chamber shown in FIG. 1. Sealing vanes 7 and 8 extend from opposite ends of the rotor along the rotor longitude 6 and contact two of the curvilinear walls such as walls 2 and 3 as in FIG. 1. Thus, in this position, the rotor divides the total chamber into two portions, a small portion C and a large portion E sometimes called the compressed and expanded portions of the chamber. The compressed portion C is the space defined by wall 1 and side 9 of the rotor and the expanded portion E is defined by side 11 of the rotor and walls 2 and 3 at the rotor position in this figure.

The basic operation of the rotor in the chamber is shown in FIG. 1. The chamber is provided inside a body which is mechanically grounded and means are provided from the same mechanical ground for carrying the rotor within the chamber so that the axis of the rotor at point 12 at the geometric center of the rotor and parallel to the chamber axis 10, moves repeatedly around the chamber axis along a three cusp hypocycloidal path 13, represented by broken lines 14, 15 and 16. In other words, the locus of positions of the rotor axis 12, as the rotor rotates within the chamber, defines a three cusp hypocycloid centered on the chamber axis.

At each position of the axis 12 of the rotor, the longitudinal axis 6 of the rotor is substantially perpendicular to a side of the three cusp hypocycloid 13 that is defined by the locus of the rotor axis 12. Thus, the lines 17, 18 and 19 span the chamber and all go through one point of the equilateral triangle 4 denoted I. Hence, the rotor rotates about an axis at I which is stationary with respect to the chamber over a portion of the rotor's rotating cycle during which the rotor axis 12 that moves with the rotor and is geometrically centrally located therein moves over one leg of the three cusp hypocycloid 13.

Upon completing rotation of the rotor about the axis I, the rotor arrives at a position where the longitudinal axis 6 coincides with side 22 of the equilateral triangle 4. Next, the rotor rotates about axis II which is fixed relative to the chamber to the next position of the rotor alongside wall 3 where the longitudinal axis 6 of the rotor coincides with leg 22 of equilateral triangle 4. Next, the rotor rotates about point III of the equilateral triangle until the longitudinal axis 6 arrives again in coincidence with leg 21 of the triangle at which point the rotor has completed one-half of a cycle of rotation about its own axis 12. Furthermore, it should be noted that when the rotor rotates from the position shown in FIG. 1, first about axis I then about axis II, then about axis III, as already described, the rotor will have completed only one-half cycle of rotation about its own axis 12 and at the end of this sequence the rotor will be upside down and backwards compared to the position shown in FIG. 1. From this position, the rotor must rotate again about axis I, then about axis II, then axis III to again be in the same position as shown in FIG. 1.

The successive positions of the longitudinal axis 6 of the rotor as the rotor rotates about axis II, represented by lines 24, 25 and 26 which span the chamber and these successive positions of the rotor axis 6 as the rotor rotates about axis III are represented by lines 27, 28 and 29.

Where the dimensions of the rotor from the tip of vane 7 to the tip of vane 8 are fixed, then the greater arcs of each of the three walls 1, 2 and 3 (each subtended by extensions of sides of the equilateral triangle 4 from the opposing points of the triangle), are equal arcs of constant radius, the centers of these arcs being at the axes I, II, and III. Furthermore, the short arcs joining these major arcs to complete the walls are subtended by the same axes I, II and III and are of equal radius. These short arcs are asymptotic to the long arcs. By this construction, all of the positions of the rotor in the chamber shown in FIG. 1 and represented by lines which span the chamber are spans of equal length and so, a rotor of fixed longitudinal dimension fits exactly between two walls of the chamber touching both walls at all times. Furthermore, the seals 7 and 8, the ends of which slide along and seal against the walls at all times, divide the total chamber in two portions, C and E which at all times are sealed from each other. These portions are generally referred to herein at the compression and expansion portions depending upon which way the rotor is moving at the time. It is the intended scope of the present invention to apply the action described hereinabove with respect to FIG. 1 in a two cycle combustion engine, a four cycle combustion engine, a fluid motor and a fluid pump.

ROTOR POSITION AND ATTITUDE CONTROL MECHANISMS

Figure 2:
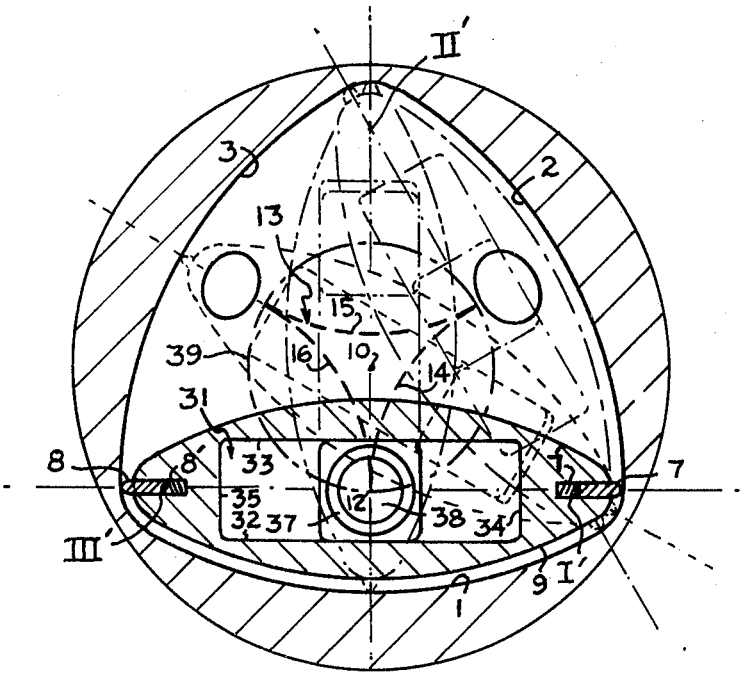
FIG. 2 is a diagram showing the chamber configuration and rotor where the rotor motion illustrated in FIG. 1 is produced with an orbiting key riding in a slot in the rotor, the center of the key orbiting around the chamber axis, whereby the key controls the position and angular attitude of the rotor in the chamber.

FIG. 2 illustrates one mechanical action for carrying the rotor in the chamber and controlling the position and attitude of the rotor over its cycle of rotation in the chamber to closely approximate the action described above with respect to FIG. 1. As shown in FIG. 2, the rotor includes a slot 31 symmetrically located along the rotor longitudinal axis 6. This slot is defined by two sides, 32 and 33 and ends 34 and 35. The slot and thus the rotor rides on a rectangular or square rotor attitude key 36, which is carried fixedly at the end of the attitude sleeve 37 that is carried rotatably on rotor axle 38. The axle 38 moves along an orbital path defined by the dot dash line 39 encircling the chamber axis 10. As this axle rotates along the orbital path 39, the sleeve 37 rotates steadily on the axle at a rate which is slower than the rate of rotation of the axle in orbit about axis 10 of the chamber. This action is achieved by an attitude gear fixed to the end of the sleeve 37 that meshes with an idler gear that in turn, meshes with a centrally located sun gear fixed with respect to the chamber. These gears and their interrelationships are described herein with reference to FIGS. 6, 9 and 11. More particularly, the rate of rotation of the sleeve and hence, the key 36 on the axle 38 with respect to the orbital rotation rate of the axle 38 about axis 10 is in the ratio of one to two. This relationship of rotations is illustrated in FIG. 2 which shows the successive positions of the rotor attitude key 36 as the geometric center of the key is moved along the orbital path 39 followed by the axle 38. Since, the rotor attitude, or more particularly, the orientation of the longitudinal axis 6 of the rotor is determined by the attitude position of the rotor key 36, the rotor itself must follow the key even while the rotor slides back and forth on the key.

FIG. 2 shows the beginning, middle and end positions of the rotor as the rotor is rotated about axis I'. The beginning position is as shown by the solid line defining the rotor in the chamber. The mid-position is shown by the broken line where the axis 6 of the rotor is at 30° relative to its initial position. When the rotor is at this 30° position, the key 36 is at one extreme end of the slot 31 and so the key has completed one-quarter of its cycle of translation in the slot. The end position of the rotor illustrated in FIG. 2 is represented by the dot dash lines showing the rotor longitudinal axis at an angle 60° to its initial position and the key 36 centered in the slot 31. At this end position, the axle 38 will have completed 120° of its orbital path around axis 10 and the key will have rotated 60° on the axle 38.

The action illustrated in FIG. 2 closely approximates the action described with reference to FIG. 1. In FIG. 2., the key 36 rotates steadily on axle 38 and axle 38 orbits axis 10 steadily. As a result, the axis I' is at the same position with respect to the chamber at the beginning, middle and end positions shown in FIG. 2, and this position is at the corner of the equilateral triangle 4 defined by the chamber. However, between these three positions, axis I' moves slightly. First it moves slightly to one side of the corner of the triangle and then back again as the rotor rotates from the beginning to the middle position, and then it moves slightly to the other side of the corner of the triangle and then back again as the rotor rotates from the middle position to the end position.

This slight deviation from the basic action described herein with reference to FIG. 1 can be compensated for where the mechanism shown in FIGS. 2, 6, 9 and 16 is used. One way to compensate is to alter the shape of the chamber slightly so that they do not follow fixed radius arcs centered at the corners of an equilateral triangle (as described with respect to FIG. 1). This is done by plotting the locus of positions of I' and then shaping the chamber walls as necessary for the rotor from vanetip to vanetip to span the walls exactly at all positions of the rotor.

Another way to compensate is to make the vanes 7 and 8 resilient or to mount them resiliently at the ends of the rotor with spring loads 7' and 8', respectively. These springs urge the vanes outward so that the vanetip to vanetip length of the rotor changes slightly as it rotates to exactly span the chamber from wall to wall even where the chamber configuration is laid out as described herein with reference to FIG. 1.

A third way to compensate includes a combination of the first two ways.

From the position of the rotor represented by the dot dash lines in FIG. 2, the rotor continues to rotate next about axis II' that moves slightly with respect to the chamber just as axis I' moves. The dot dot dash line shows the position of the rotor having rotated 30° about axis II'. This rotation of the rotor is a result of the continued orbital rotation of the axle 38 along the path 39 about axis 10 and the continued slower rotation of the key 36 on axle 38 just as already described. At this position of the rotor, represented by the dot dot dash line, the key again reaches an extreme position in the slot. This action continues until the axle 38 completes an orbit along an orbital path 39 about the axis 10 of the chamber returning to the same position represented by the solid lines in FIG. 2. This results in one-half cycle of rotation of the rotor about its own geometric center, the locus of which is represented by the three cusp hypocycloid figure 13 (represented by broken lines in FIGS. 1 and 2).

Upon returning the first time to the initial positions, shown by the solid lines in FIG. 2, the rotor will have rotated one-half cycle about its own geometric axis and the expansion portion of the chamber will have been swept by the rotor three times. Clearly, upon completing a full cycle of rotation of the rotor about its own axis, the expansion portion of the chamber will have been swept by the rotor six times. Thus, it is seen one cycle of rotation of the rotor compresses and expands six times.

Another mechanism for controlling the position of the rotor within the chamber so that it is positioned and forced to rotate as described with reference to FIG. 1, is illustrated in FIG. 3. The rotor 5 is mounted on rotor axle 41 concentric with the centrally located axis 12 of the rotor. A bearing 42 is provided to accomodate this mounting. The axle 41 is carried eccentrically at one end of a shaft 43. At the other end of the shaft 43 is a gear 45 concentrically located on the shaft and which meshes with a large stationary inside gear 46 concentric with the chamber axis 10. The locus of the meshing of the smaller gear (which is also called an orbital gear) and the large stationary gear is represented by dot dash line 44. The ratio of these two gears, the orbiting gear and the stationary gear is three to one and so, each rotation of the orbiting with respect to the point where the two gears mesh, gear moves it 120° around the stationary gear.

FIG. 3 shows the three positions of the orbiting gear and the axle 41 carried eccentrically of the gear, at each cycle of rotation of the orbiting gear on the stationary gear. The initial position is represented by the solid line showing the axle 41 and bearing 42 carrying the rotor 5 eccentrically with respect to the shaft 43 that is, in turn, concentric with the orbital gear 45. From the initial position represented by solid lines in FIG. 3 the orbital gear 45 rotates two revolutions with respect to the stationary housing and three revolutions with respect to gear 46, and so, moves completely around the inside gear 46. The three revolutions around the inside of gear 46 describes the same three cusp hypocycloid 13 as shown also in FIGS. 1 and 2. The cusp defines the required locus points of the geometric center of the rotor in order to accomplish the rotor movement described herein with reference to FIG. 1, and so it is clear that the mechanism shown in FIGS. 3 and 10 can be used to control the position and attitude of the rotor to accomplish the described motion. This mechanism does not itself rotate the rotor, but rather moves the geometric center of the rotor (axis 12) over the locus points that define the three cusp hypocycloid, allowing the rotor to rotate on the axle 41 (axis 12) as necessary to exactly span the chamber at all times. Thus, this mechanism functions alone to control the position of the center of the rotor in the chamber and it functions in conjunction with the chamber walls 1, 2 and 3 to control the attitude of the rotor at all positions.

Figure 10:
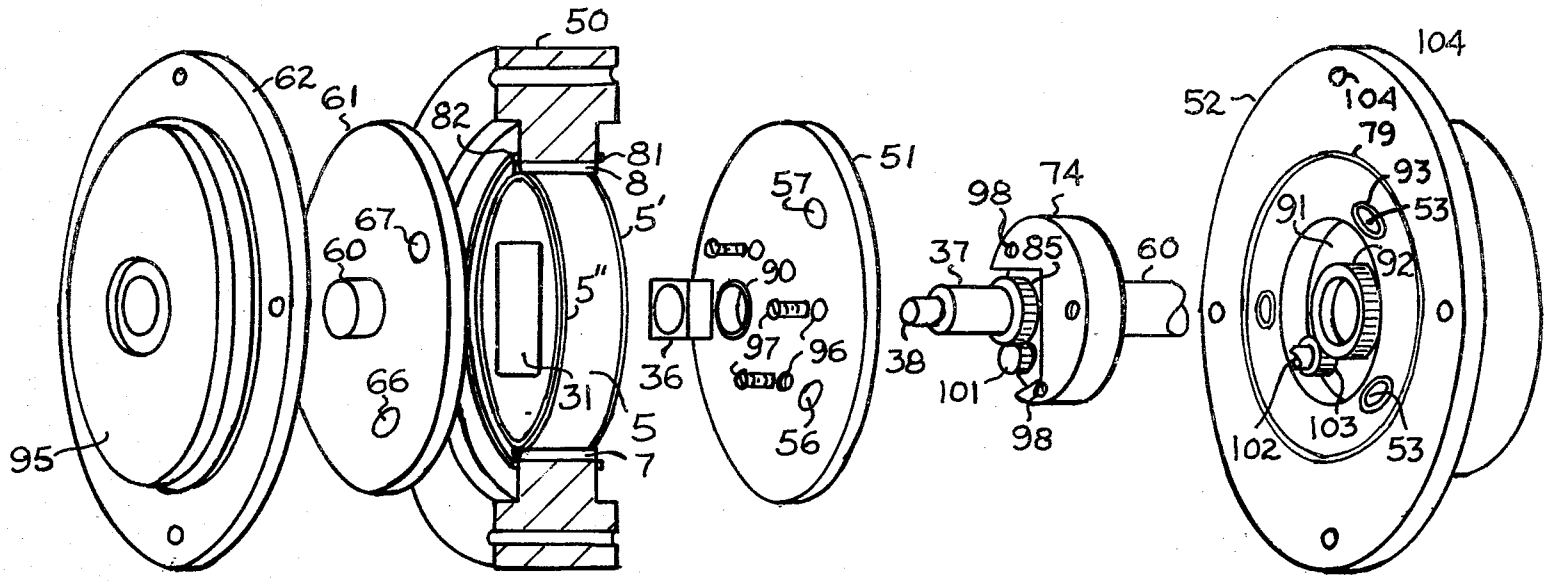
FIG. 10 is an exploded three-quarter view of the two cycle engine shown in FIGS. 6 to 8 showing the parts thereof as they are assembled.

The mechanism shown in FIGS. 3 and 10 is operable with a rotor having fixed (non-resilient) vanes so that there is no variation of the dimensions of the rotor from vanetip to vanetip, in a chamber laid out, without deviation from the basic chamber configuration described herein with respect to FIG. 1. Thus, the axes I, II and III in FIG. 3 may remain stationary with respect to the chamber. However, there exists the dependence upon vane wall contact to rotate the rotor on the axel.

With either of the mechanisms for controlling the position and attitude of the rotor in the chamber described herein with reference to FIGS. 2 and 3, all points on the rotor move with respect to the chamber and so there is no continually stationary pivot point or axis in the chamber that is all times coincidental with a pivot point on the rotor that is stationary on the rotor. Hence, the rotor must be carried by another body that moves with respect to the chamber and it is convenient that that body form part of the chamber walls. More particularly, the rotor may be carried on a disc which is also an end wall of the chamber and lies in a plane perpendicular to the chamber axis 10. Such a disc for carrying the rotor is the disc 51 shown in FIG. 4. This disc is concentric with the chamber axis 10 and rotates on a bearing concentric with that axis. It covers one end of the chamber formed within the chamber body 50.

The rotor 5 may be carried on the disc by either of the mechanisms described herein with reference to FIGS. 2 or 3, or by any other mechanism for controlling the position and attitude of the rotor, as described with reference to FIG. 1. In any case, the rotation rate of the disc is twice the rotation rate of the rotor about its own centrally located axis 12. Thus, the disc serves to close one end of the chamber and also it is part of the mechanism that carries the rotor within the chamber and the mechanism that controls the position and attitude of the rotor in the chamber. In addition to this, the disc may serve to open and close exhaust and/or intake ports which communicate with the compression and expansion portions of the chamber during operation in an internal combustion engine, a fluid motor or a fluid pump.

In all embodiments, flush peripheral seals 5' and 5'' are carried by the rotor on each side thereof and sealably slide against the end discs such as discs 51 and 61. These seals and vanes 7 and 8 prevent fluid flow between the compression portion C and the exhaust portion E of the chamber.

EXHAUST AND INTAKE PORTS AT THE ENDS OF THE CHAMBER

As shown in FIG. 4, the chamber defined by the walls 1, 2 and 3 is formed inside the chamber body 50 and the disc 51 seals one end thereof and may carry seals to insure the disc and the body 50 are at all times sealed against leakage of gas or fluid. The exhaust housing 52 on the other side of the seal connects rigidly to the chamber body 50 and may be mechanically grounded. Exhaust ports are provided in this housing at fixed locations and so the exhaust ports are fixed with respect to the chamber. Three such exhaust ports are shown by dash lines in FIG. 4, and denoted 53, 54 and 55. Two similarly located openings are provided in the disc 51, denoted 56 and 57, and may be slightly smaller than the ports 53 to 55 in the housing. At the position of the rotor and the disc with respect to the housing shown by solid lines in FIG. 4, the openings 56 and 57 in the disc are in registration with the ports 53 and 54 in the housing 52. Thereafter, as the disc rotates counterclockwise and the rotor rotates about its own moving axis 12 in the clockwise direction, the successive positions of the rotor and the disc openings are as illustrated by broken lines in FIG. 4. For example, the solid lines show a position of the rotor when the exhaust portion of the chamber, defined by walls 2 and 3 and surface 11 of the rotor, is opened to the ports 53 and 54. Thereafter, as the rotor rotates about its own axis 12 clockwise to the position represented by the dash lines, the two openings 56 and 57 in the disc will move out of registration with the ports 53 and 54 in the housing to the positions shown by dash lines 56' and 57'. At the next position of the rotor represented by the dot dash line, disc hole 56 will be in registration with port 54 and disc hole 57 will be in registration with port 55. This action of the rotor disc to align disc holes and exhaust ports is illustrated further by FIGS. *5a* to *5g* which are diagrams showing the positions of the rotor and the positions of the holes in the disc and indicating whether these holes are or are not in registration with stationary housing ports.

Figure 6:
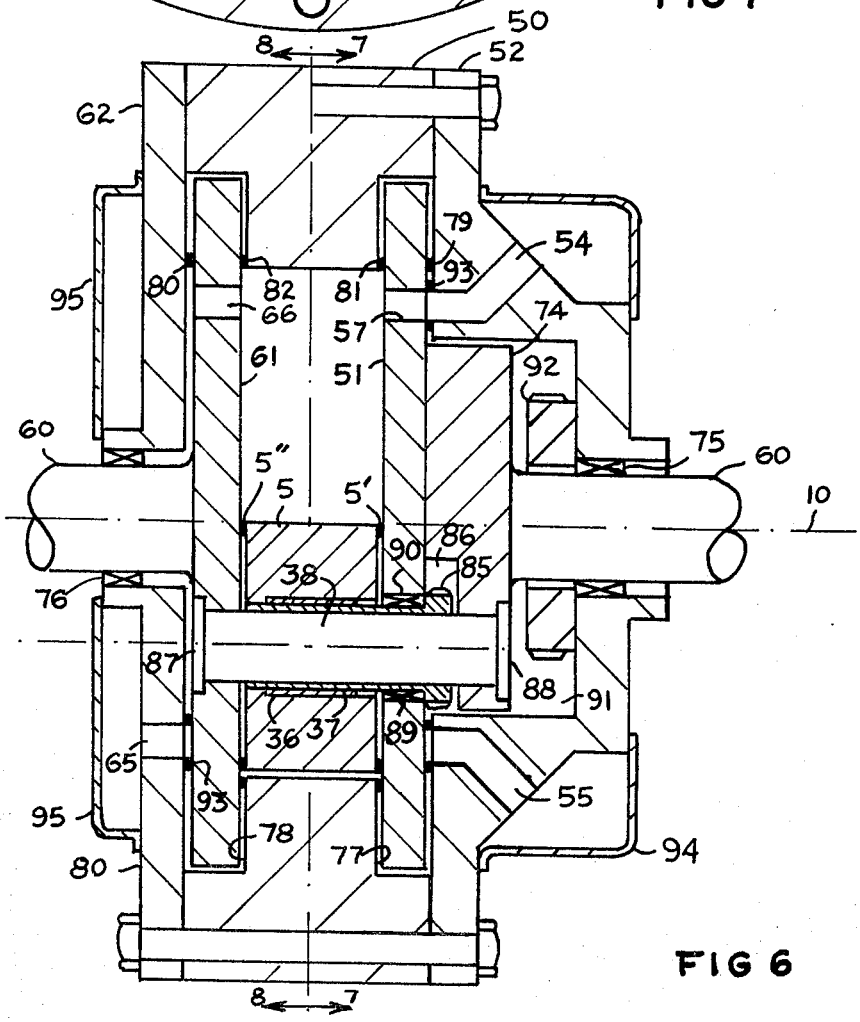
FIG. 6 is a cross section view taken as shown in FIG. 7 of a single piston and cavity, two cycle internal combustion engine incorporating features of the present invention and illustrating one attitude control mechanism, the gears which drive this mechanism, the exhaust and intake discs that carry the rotor and an exhaust port in the exhaust housing.

As shown in FIG. 6, a second disc 61, the same size as the first disc 51 covers the other end of the chamber and preferably rigidly connects to the first disc by a part of the mechanism for controlling the rotor position and attitude. For example, where the mechanism shown in FIG. 2 is used, the axle 38 is rigidly connected to both discs. Where the mechanism shown in FIG. 3 is used, both discs are on shaft 43. In either case, both discs may be supported also by large diameter bearings at their outer peripheries, carried by the chamber body 50.

TWO CYCLE OPERATION OF EXHAUST/INTAKE PORTS

If the first disc 51 is the exhaust disc, the holes 56 and 57 therein are the exhaust holes, housing 52 is the exhaust housing and ports 53, 54 and 55 are exhaust ports. Then the second disc 61 is the intake disc and is adjacent the intake housing 62. The intake housing includes intake ports 63, 64 and 65 and the intake disc includes intake holes 66 and 67. The alignment of the intake holes and ports as the discs rotate is the same as for the exhaust holes and ports, except that the time sequence of said alignment with respect to the rotor position will differ depending upon how this rotary piston mechanism is used. For example, when this mechanism is used in a two cycle internal combustion engine, as shown in FIG. 6, exhaust and intake occur in rapid succession at the expansion portion of the chamber. As this portion approaches full expansion, exhaust occurs, then the exhaust ports close and then intake occurs before compression begins. Thus, arrangement of holes and ports for both exhaust and intake may be the same, but staggered so that exhaust and intake occur in the desired sequence as well as at the desired position of the rotor. This staggered arrangement is shown and described with respect to FIGS. 7 and 8.

The sequence of FIGS. 5a to 5g show the operation as a two cycle internal combustion engine. These figures represent the view from the rotor toward the exhaust end or toward the intake end of the chamber and show the condition (open or closed) of the ports in the exhaust or intake housings. FIGS. 5a to 5g show the exhaust port conditions in sequential steps. The corresponding intake port conditions in the same sequential steps are shown by the same figures in the reverse order 5g to 5a.

Intake or exhaust openings into the chamber may also be provided axially or radially. For example, either intake or exhaust or both may be through central axial openings in the discs concentric with the chamber axis 10 and the drive shaft 60. Where such a central opening is provided in the disc, the shaft on the outside of the disc is hollow and so provides a connecting passage to the disc opening. A control valve in the hollow shaft or in a conduit to the hollow shaft would control the timing of flow therethrough. Where intake is provided by this technique and exhaust is through the rotating exhaust disc holes as they align with exhaust ports in the exhaust housing, exhaust occurs first and then intake and so the intake would be delayed with respect to the exhaust to insure that they do not both occur simultaneously. This could be implemented by adding a control valve before the intake opening in the drive shaft that attaches to the intake disc, which delays input until the holes in the rotating exhaust disc move just out of registration with the exhaust ports. FIGS. *5a* to *5g* may represent this action also. As shown by these figures, the power stroke is initiated by a spark from spark plug 71 driving the rotor 5 in its clockwise rotation about axis I. In FIG. *5b*, the rotor is shown half way rotated about axis I to its position adjacent wall 2 of the chamber. At this midway point, all the exhaust ports as well as the intake ports are closed and so the power expansion continues in one portion of the chamber and compression of the combustible mixture taken in occurs in the other portion of the chamber. This cycle completes at the position shown in FIG. 5c where the exhaust ports 54 and 55 are open commencing the next cycle of the engine. This next cycle of the engine and the third cycle shown are in the subsequent FIGS. *5d*, *5e*, *5f* and *5g*.

TWO CYCLE INTERNAL COMBUSTION ENGINE

Figure 7:
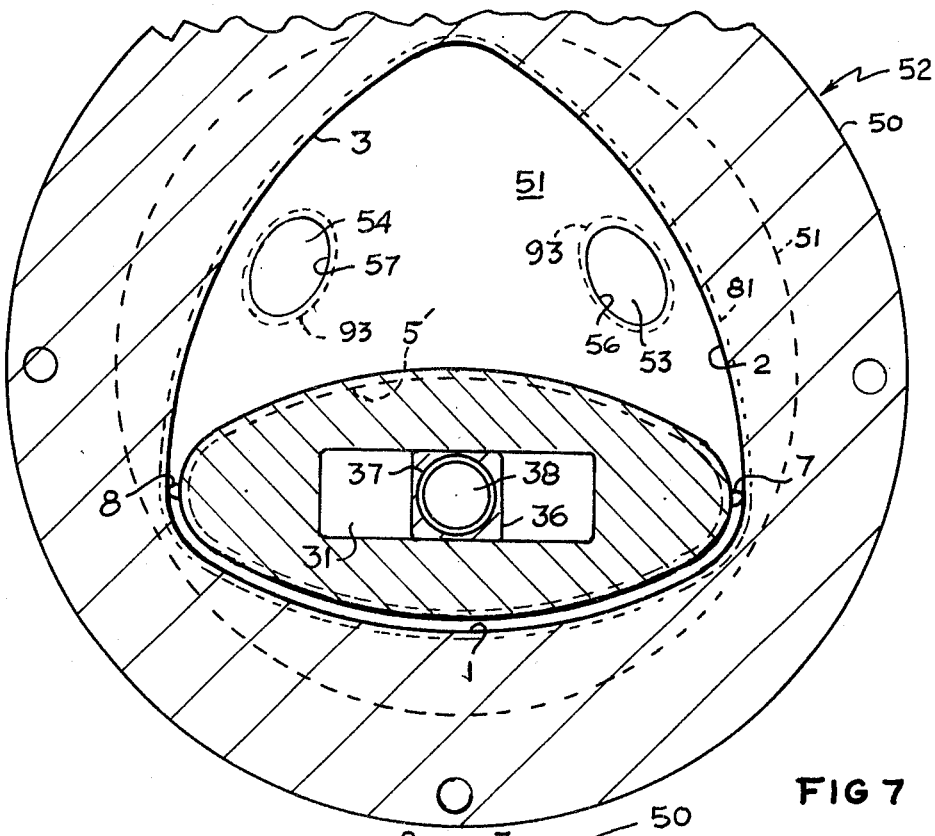
FIGS. 7 and 8 are cross section views of the two cycle engine shown in FIG. 6, toward the exhaust and intake sides, respectively, transverse to the chamber axis.
Figure 8:
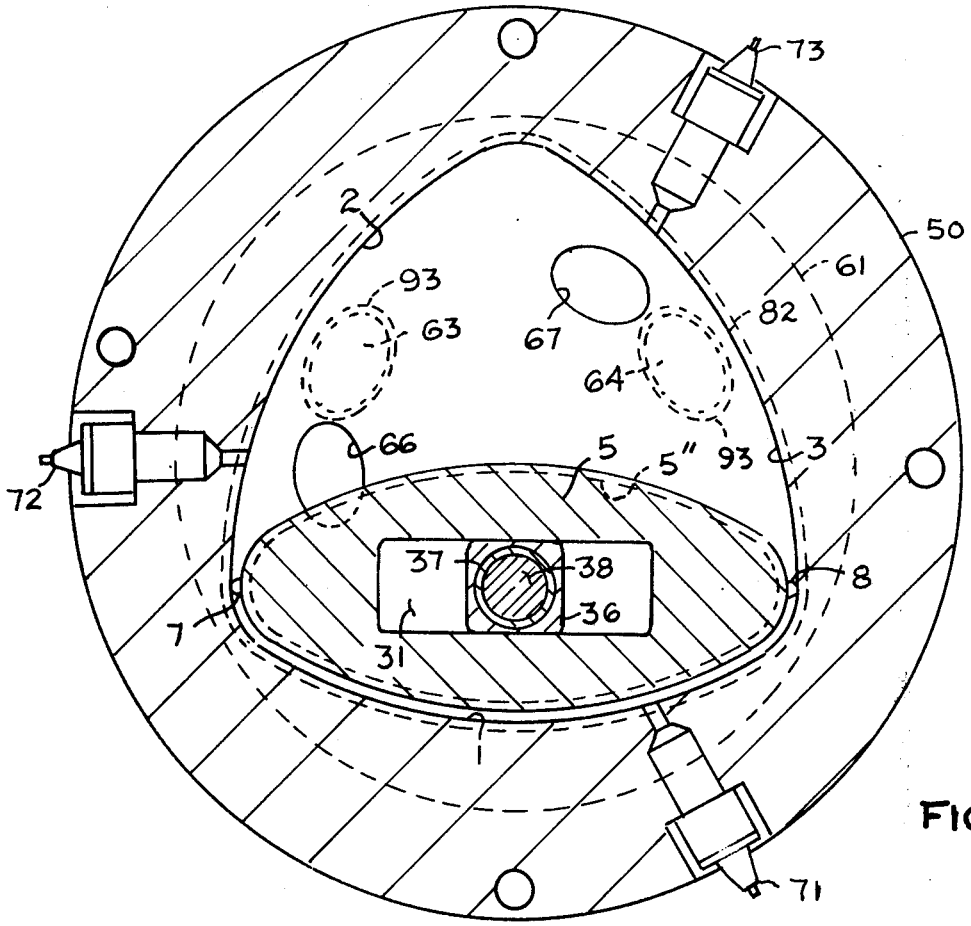
Figure 11:
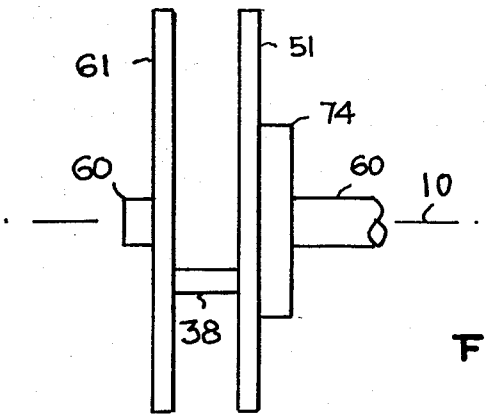
FIG. 11 is a slide view showing the assembly of the exhaust and intake discs showing the crankshaft appearance of this assembly.

A two cycle internal combustion engine including exhaust and intake disc holes and ports and operating as described with reference to FIGS. 4 and *5a* to *5g* is shown in FIGS. 6 to 8. Furthermore, an exploded view of the parts of this engine and additional details of the parts are shown in FIGS. 10 and 11. Referring first to FIG. 6, a cross section view of the two cycle engine is shown, taken as shown in FIG. 7. The chamber body 50 is generally cylindrical on the axis 10 and provides the walls 1, 2 and 3 that define the shape of the chamber as already described with reference to FIGS. 1 to 4. The exhaust end of this chamber is closed by the exhaust disc 51 and the intake end is closed by the intake disc 61. The exhaust gear holder 74 fixedly attaches to the outside of the exhaust disc and carries the output drive shaft 60, carried on the drive shaft bearing 75 and 76 attached to the exhaust housing and intake housing 62, respectively, all concentrically located on the axis 10.

The exhaust and intake discs 51 and 61 are rigidly connected together by rotor axle 38. This axle attaches fixedly to the gear holder 74 which attaches fixedly to the exhaust disc. Hence, the assembly of the exhaust and intake discs rigidly connected by axle 38 with the output drive shaft 60 extending from the exhaust and intake discs, has the appearance and action of a crankshaft. This assembly is shown in FIG. 12.

The exhaust and intake housings 52 and 62 and the chamber body 50 are bolted together with the disc assembly shown in FIG. 12 carrying the rotor between the discs, the disc assembly being free to rotate on the output shaft 60 by virtue of bearings connecting each end of this shaft to the housings. As shown in FIG. 6, the exhaust and intake discs extend beyond the walls 1, 2 and 3 of the chamber into recesses 77 and 78, respectively, in the chamber body 50. In these recesses it is preferred that there be provided seals between the discs and the chamber body to prevent leakage of gas from the chamber around the discs to the main bearings 75 and 76 carried by the housings. Accordingly, circumfrential seals 79 and 80 are provided in the recesses 77 and 78, respectively, sealing against the exhaust and intake discs. Additional seals may also be provided between the discs and their housings anywhere between the housings and the end of the discs. For example, seals 81 and 82 may be provided in the exhaust and intake housings for this purpose. Furthermore, large circumferential bearings may be provided between seals that engage each disc, the bearings being attached to the circumference of the disc and to the chamber body 50. Such bearings are not shown, however, they could be provided to insure that the discs rotate smoothly with respect to the chamber body 50.

Details of construction of the rotor axle 38 that rigidly connects the exhaust and intake discs, the attitude sleeve 37 carried on this axle, the rotor attitude key 36 fixed to the sleeve, the rotor and the rotor attitude gear 85 located in the recessed gear space 86 between the exhaust disc 51 and the gear holder 74 that is attached to the disc are shown in FIG. 6. In this figure, the exhaust and intake discs are securely fastened together by the axle 38 attached at one end by the axel head 87 to the intake disc 61 and attached at the other end by axle head 88 to the gear holder 74. The rotor attitude sleeve 37 fits slideably on the axel and extends from the attitude gear located in the recess 86 between the exhaust disc and gear support, through bearing 89 held in an opening 90 in the exhaust disc 51 along the axle 38. Thus, the sleeve 37 and attitude gear 85 rotate freely on the axle 38 and so, this gear controls the attitude of the rotor in the chamber.

The attitude gear meshes with an idler gear alongside it contained in the same recess 86 on an axle carried by the gear support 74 and a companion idler on the same shaft is located in the exhaust housing stationary gear well 91 that also contains the fixed centrally located stationary gear 92. The exhaust gear holder 74 and the exhaust housing 52 are shown in FIG. 11 also.

FIGS. 7 and 8 are cross section views of the engine taken across the axis 10, as shown in FIG. 6. The view in FIG. 7 toward the exhaust side of the chamber. The view in FIG. 8 is toward the intake side of the chamber and shows the locations of spark plugs 71 to 73 which ignite the combustible mixture compressed against the chamber wall where the spark plug is located through a small opening at the end of the spark plug. These spark plug openings are denoted 71' to 73', respectively. As can be seen from these views, the holes in the exhaust and intake discs at the same rotor position are slightly staggered, so that the exhaust leads the intake.

The exhaust ports 53 to 55 in the housing may include at the ends thereof adjacent the exhaust disc, a ring-like seal such as seal 93 shown in FIG. 6 pressed against the exhaust housing tending to maintain the port closed except when in registration with the exhaust holes 56 or 57 in the disc. The exhaust ports 53 to 54 in the housing empty into an exhaust manifold 94 which may be carried on the outside of the exhaust housing and an opening (not shown) in this manifold vents the exhaust to the atmosphere.

The intake ports 63 to 65 in housing 62 can also include ring-like seals such as 93 pressed into the housing to seal these ports closed against the intake disc except when in registration with the intake holes 66 and 67. These ports are fed from the intake manifold 95 carried on the outside of the intake housing 62. A carburetor mechanism (not shown) feeds a combustible mixture of fuel and air to this manifold.

All of the parts of the two cycle internal combustion engine shown in FIGS. 6 to 8 are shown also in the exploded view of this device in FIG. 10. In addition, FIG. 10 shows screws and screw clearance holes in the exhaust disc 51 and accomodating tapped screw holes in the exhaust gear holder 74 for fastening them securely together. The clearance holes 96 and the exhaust disc accomodate the screws 97 which threadably connect to tapped holes 98 in the gear holder 74. In FIG. 10, this gear holder includes a recess 86 adjacent the exhaust disc in which are located the rotor attitude gear 85 on the end of sleeve 37 carried on the rotor axle 38. An idler gear 101 in the recess 86 meshes with the attitude gear and is on an axle 102 that extends through the holder to a matching idler gear 103 on the other side thereof located in the stationary gear well 91 of the exhaust housing. This matching gear meshes with the stationary gear 92 fixed to the housing concentric with the chamber axis 10. Accordingly, when the gear holder 74 and exhaust disc 51 are assembled and the exhaust disc is then assembled with the intake disc 61 with the rotor 5 and chamber body 50 in between, this subassembly is then assembled with the exhaust and intake housings so that the output shaft 60 is supported on the bearings in these housings and the corresponding bolt holes 104 in the housings and the chamber body align. The total assembly is then bolted together.

Figure 9:
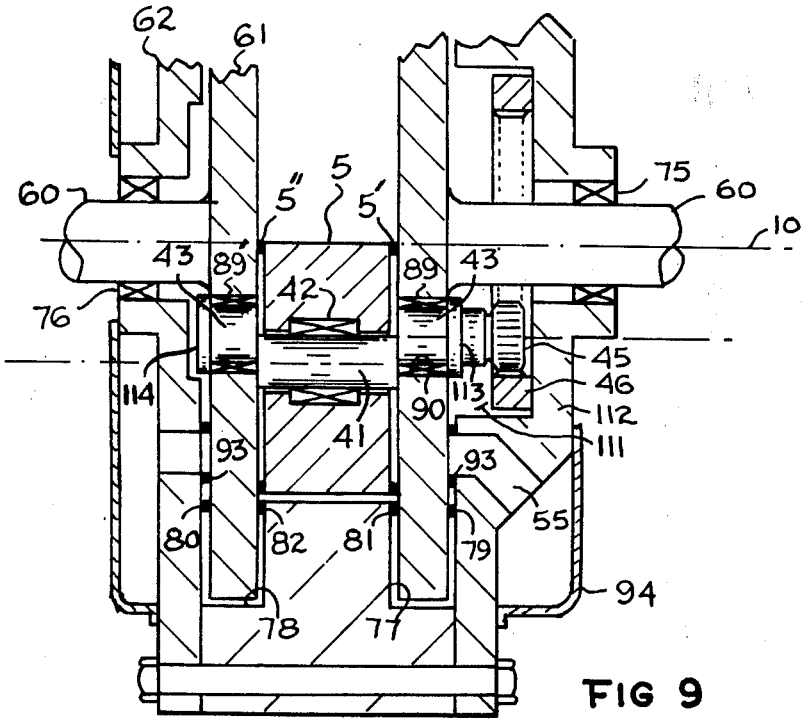
FIG. 9 is a view similar to FIG. 6 of a similar two cycle internal combustion engine wherein the rotor position and attitude control mechanism is constructed in accordance with FIG. 3 and includes an orbiting gear and an eccentrix axle extending from the gear shaft, the rotor being centrally mounted on the eccentric axle.

The two cycle internal combustion engine shown in FIGS. 6 to 8 incorporates the rotor attitude and position control mechanism including a key and slot described with reference to FIG. 2, could also be used in the engine shown in these figures. FIG. 9 is a cross section view taken through the axis 10 showing an adaptation of the same two cycle internal combustion engine equipped with the control mechanism of FIG. 3. In this emodiment, there is no need for the gear holder 74 attached to the exhaust disc and only two gears are used, the planetary orbiting gear 45 and the fixed inside gear 46. These gears are located in the gear well 111 concentrically located in the exhaust housing 112.

This housing 112 may be exactly the same as exhaust housing 52 shown in FIGS. 6 through 10, except that the well 111 need not accomodate a gear holder. The axle 43 of the planetary gear 45 is carried by the bearing 89 in the hole 90 in the exhaust disc 51. This axle is split, the one end nearest gear 45 is held by the bearing 89 in the exhaust disc and the other end is held by a bearing 89' through the intake disc 61. Collars 113 and 114 on axle 43 at each end of the axle on the outsides of the exhaust and intake discs hold these discs on the axle.

Between the split ends of the axle 43 fixedly attached to the axle and eccentrically located is the eccentric rotor axle 41. Rotor 4 is mounted on axle 41 by bearing 42. Thus, the split axle 43 and eccentric axle 41 attached thereto is a rigid structure which connects the exhaust and intake discs. The output drive shaft 60 is fixedly attached to the exhaust disc 51 on one side and to the exhaust disc 61 on the other side and is carried by the shaft bearings 75 and 76 in the housings.

Bearing 42 is a one way clutch as well as a bearing and so, rotation of the piston 5 on axle 41 is clockwise only as viewed toward the exhaust disc 51.

The location and alignment of exhaust and intake ports in the exhaust and intake housings with holes in the exhaust and intake disc and the location of seals sealing the discs against the passage of gas may all be as already described above with reference to FIGS. 6 to 8. Thus, the two cycle internal combustion engine shown in FIG. 9 operates in all respects substantially as the engine shown in FIGS. 6 to 8 and all other features of that engine may be applied to the engine shown in FIG. 9.

FOUR CYCLE INTERNAL COMBUSTION ENGINE

The two cycle internal combustion engine shown in either of FIGS. 6 or 9 can be operated as a four cycle engine. However, in four cycle operation intake and exhaust to the chamber through openings in the intake and exhaust discs which align with the exhaust ports in the housings cannot be readily accomplished. Instead, fuel intake and exhaust passages into the chamber are provided by way of radial openings through the chamber body which open at the chamber walls 1, 2 and 3. Furthermore, since it is not possible to exert a power stroke each time the rotor rotates successively about the axes I, II and III, there cannot be six power strokes for each revolution of the rotor. FIGS. 14*a* to 14*f* show one sequence of rotation of the rotor in the chamber to perform as a four cycle internal combustion engine with intake, compression, power and exhaust subcycles accompanying each power stroke.

As shown in FIGS. 14*a* to 14*f*, the rotor rotates six times about the axes I, II and III in succession. The first rotation about I is a power stroke, the next about II is also a power stroke, the next about III is an intake stroke, the next about I is an intake stroke, the next about II is a power stroke and the last about III is also a power stroke. Thus, two power strokes occur in succession followed by two strokes which do not deliver any power, and this is again followed by two power strokes to complete one cycle of rotation of the rotor in the chamber. It should be noted that the first power stroke shown in FIG. 14*a* is accompanied by a compression stroke and the second is accompanied by an exhaust stroke and so forth as indicated in these figures.

In a four cycle engine incorporating the present invention, two chambers in tandem are provided, each containing a rotor, both carried on a single output drive shaft. Two chambers (or an even number of chambers) are preferred so that the action in each can be staggered with respect to the action in the other. For example, if the action in the first chamber (referred to herein as the A chamber) is as represented by FIGS. 14*a* to 14*f*, then the action in the second chamber adjacent thereto (referred to herein as the B chamber) would be represented by FIGS. 15*a* to 15*f*. More particularly, while the A chamber is performing a power/compression stroke as shown in FIG. 14*a*, the B chamber is performing an intake/exhaust stroke as shown in FIG. 16*a*. Furthermore, while the A chamber is performing an intake/exhaust stroke as in FIG. 14*c*, the B chamber is performing a power/compression stroke as in FIG. 15*c*, and so forth. Thus, the two rotors in the two chambers perform six power strokes for each rotation of the rotors. Or expressed in another way, there are three power strokes for each cycle of rotation of the crankshaft structure formed by the rotors, exhaust and intake discs and output drive shaft.

A two chamber, two rotor, four cycle internal combustion engine operating substantially as shown in FIGS. 14*a* to 14*f* and 15*a* to 15*f* is shown in cross section in FIG. 12. In this structure, a mechanism for controlling the position and attitude of each rotor in its chamber is the same as the mechanism shown in detail in FIGS. 2 and 6. That is, each rotor includes a slot into which slideably fits a rotor attitude key carried at the end of a rotor attitude gear on a fixed axle that connects the exhaust disc with the intake disc. However, in this four cycle embodiment, the intake disc does not provide an opening for injecting a combustible mixture into the chamber. In this embodiment, all combustible intake into and all exhaust from the chambers is through ports which extend substantially radially from the chamber walls 1, 2 and 3 through the chamber bodies that contain the chamber. Suitable valving is provided to control the flow of intake and exhaust through these ports in synchronism with the operation of the engine.

Within the A chamber is located rotor 105*a* and in B chamber is located rotor 105*b*. As already mentioned, the mechanisms for controlling the position and attitudes of these rotors in their chambers is the same as already described herein with respect to each other. For example, chamber A is disposed right side up as represented in FIGS. 14*a* to 14*f*, and chamber B is disposed upside down as represented in FIGS. 15*a* to 15*f*. This is clearly shown in FIG. 13.

Dividing the two chambers, A and B is a disc 161 which functions with regard to the two chambers very much as the intake disc 61 shown in FIGS. 6 through 8. More particularly, axels 38*a* and 38*b* which connect rigidly to the discs 151*a* and 151*b*, respectively, also connect rigidly to the central disc 161.

The position and attitude control mechanism for carrying and positioning rotor 105*a* in the A chamber is denoted generally 162*a* and the same mechanism for carrying rotor 105*b* is denoted 162*b*. These mechanisms, the discs they are mounted to, the gear holders, the idler gears, the stationary gear and the mounting to their associated housings 152*a* and 152*b* are all as already described herein with reference to FIGS. 6 to 8. Hence, a detailed description of these mechanisms is not included herein with reference to this four cycle engine embodiment.

FIG. 13 is a cross section view taken through the B chamber as shown in FIG. 12. This reveals the location of the radial intake and exhaust ports as well as the spark plugs 171*b*, 172*b* and 173*b* for the B chamber. As shown here, there are provided three intake ducts 174*b*, 175*b* and 176*b* through the chamber body 150*b* and opening at the walls 101*b*, 102*b* and 103*b*, respectively, of the B chamber alongside the spark plugs of this chamber. The chamber body 150*b* also contains exhaust ports from which are denoted 181*b*, 182*b* and 183*b*. Similarly located intake and exhaust openings are provided in the chamber A enclosure 150*a* as well as spark plugs denoted 171*a*, 172*a* and 173*a*. The radial intake and exhaust openings into chamber A are not shown, but are located relative to that chamber just as the radial intake and exhaust ports to chamber B are located with respect to that chamber.

FLUID MOTOR AND FLUID PUMP

Figure 16:
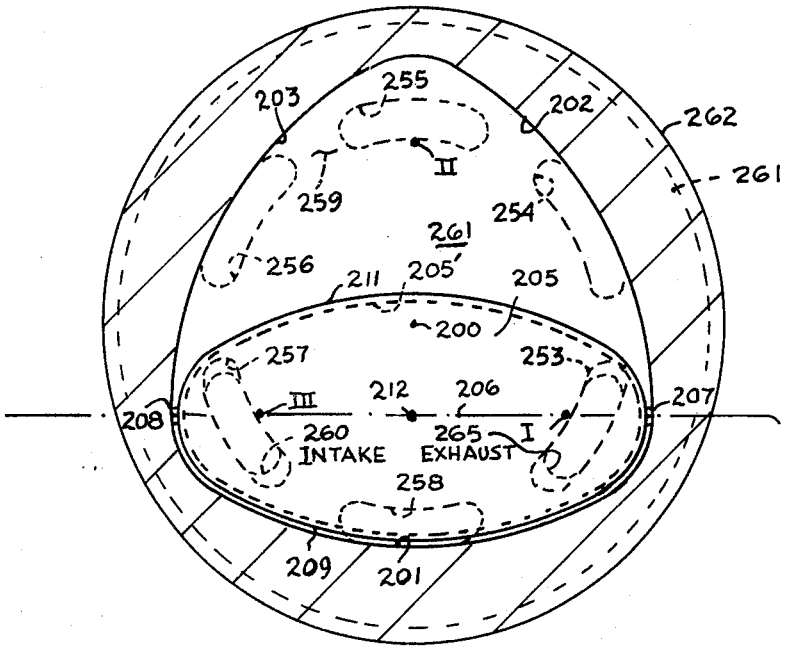
FIG. 16 is a diagram showing the chamber rotor and exhaust and intake system for a fluid motor, fluid pump or compressor incorporating features of the present invention.

The operation of a fluid motor and a fluid pump or compressor, incorporating the basic action and the rotor and chamber configuration of the present invention, can be understood by reference to the intake and exhaust port action illustrated in FIG. 16. This figure shows the rotor, chamber body, intake disc and intake housing with intake holes and ports that align that permit intake into the chamber from one side thereof and exhaust holes and ports that align to permit exhaust from the opposite side of the chamber.

The chamber walls 201, 202 and 203 may conform to the walls 1, 2 and 3, respectively, described with reference to FIGS. 1 and 4 and the rotor position and attitude control mechanism (not shown here) may be the same as shown in FIGS. 2 or 3. However, the shape of the rotor 205 is somewhat different from rotor 5 and may carry double vanes 207 at one end and 208 at the other end. The rotor is symmetrical with respect to its longitudinal axis 206 and the sides 209 and 211 conform closely with the walls 201, 202 and 203 when the rotor closes with a wall. Accordingly, when the rotor has closed with a wall, as shown in FIG. 16, the width of the rotor transverse to its longitudinal axis may be so great that the rotor covers the chamber axis 200.

The intake disc 261 covers the intake end of the chamber against the chamber body 250 and is enclosed by the intake housing 262 similar to the arrangement of disc 61 chamber body 50 and housing 62 and seals shown in FIG. 6. An axle shaft extends from the center of the disc to bearings in the housing also as shown in FIG. 6. The exhaust disc (not shown) covers the other end of the chamber and is supported by the central shaft at a bearing in the housing that encloses that disc, similar to the exhaust disc and exhaust housing shown in FIG. 6.

In general, the configuration of the fluid motor or pump is the same as the two cycle engine shown in FIG. 6, except that the locations of the intake and exhaust ports are somewhat different. The similarity to FIG. 6 includes the connection of the two discs at each end of the chamber to provide a crankshaft-like structure for holding the rotor and a mechanism carried on one side of this crankshaft-like structure for controlling the position and attitude of the rotor in the chamber. Also, the intake and exhaust discs which close the ends of the chamber serve also to open and close intake and exhaust ports to the chamber.

The intake into the chamber is through elongated ports 253 to 258 in the housing 262 which provide a continuous annular opening except for support structure such as 259 between each opening. The single intake hole 260 in disc 261 aligns with one of these elongated ports at a time as shown in FIG. 16. When the rotor covers the intake hole 260, as shown in this figure, flow into the chamber through the hole is blocked. The rotor peripheral seals 205' and 205'', seal against the intake and exhaust discs that close the chamber and prevent flow from the covered hole into either the compression or the expansion portions (C or E) of the chamber.

Exhaust from the expansion side of the chamber is through a single exhaust hole in the exhaust disc (not shown). The exhaust disc and exhaust housing may be constructed substantially the same as the intake disc 261 and intake housing 262. The exhaust housing may also contain a plurality of elongated ports just like intake ports 253 to 258. In fact, the only significant difference between the intake system and the exhaust system is that the intake hole 260 and the similar exhaust hole in the exhaust disc are always on opposite sides of the rotor. For example, when the rotor is positioned as shown in FIG. 16, the intake hole 260 is in the position shown and the exhaust hole is at the position indicated by the dot dash line 265. Both these holes are covered by the rotor.

Figure 17:
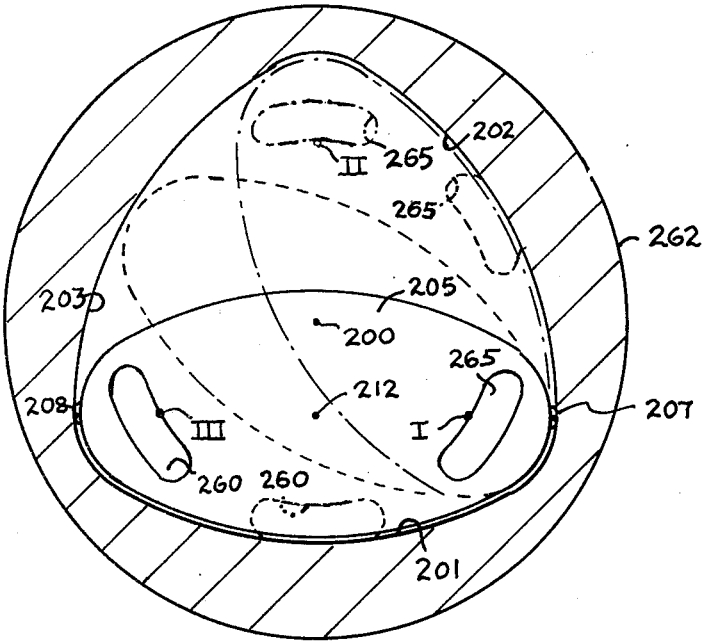
FIG. 17 is a diagram serving to explain the operation of the intake and exhaust system in the fluid motor, fluid pump or compressor.

Thereafter, as the rotor rotates about axis I, the intake and exhaust holes move counterclockwise as viewed in FIG. 16 at twice the rate of rotation of the rotor about the central rotor axis 212. Successive positions of the rotor and intake and exhaust holes are shown in FIG. 17. The solid line rotor position corresponds with the solid line intake and exhaust hole positions 260 and 265, respectively. At the solid line position, both holes are covered by the rotor.

When the rotor rotates a few degrees from the solid line position, both intake and exhaust holes move out from under the rotor. At the thirty degree rotor position, represented by the dash line, both holes are well uncovered and both remain at least partially uncovered until the rotor reaches the sixty degree rotor position represented by the dot dash line. The corresponding hole positions are also represented by dot dash lines and again, they are both covered by the rotor.

This sequence continues and provides a fundamental rotary piston mechanism for use in a fluid motor, fluid pump or compressor. In a fluid motor, high pressure fluid is fed to the intake ports and a starting torque is applied to the shaft that connects to the intake and exhaust discs to initiate the motor action. Then at each position when the rotor covers the intake and exhaust holes, inertia carries the rotor through the position to again uncover the holes and so, continues the motor cycle.

In a fluid pump or compressor, the periodic covering of both intake and exhaust holes by the rotor creates no problem. It very briefly interrupts the intake and exhaust and if the fluid is a gas, this interruption is hardly noticeable.

The numerous embodiments of the present invention illustrate adaptations of the invention for two and four cycle internal combustion engines and for fluid motors, pumps and compressors. These represent the best known uses of the rotary piston action that is described and it will be apparent to those skilled in the art that various changes, modifications and other applications of the basic action can be made without departing from the spirit and scope of the invention as set forth in the appended claims.

What is claimed is:

1. A rotary piston mechanism for internal combustion engines, fluid motors, pumps and the like comprising, an outer body having means forming a chamber therein, a rotor confined in said chamber, said chamber having a chamber axis circumscribed by three equal curvilinear walls defining an equilateral chamber triangle in a plane perpendicular to the chamber axis, said three chamber walls being convex with respect to the chamber axis, said rotor being generally elongated, of length equal to the span of the chamber along the bisector of any angle of said equilateral triangle and having a rotor axis centrally located therein and parallel to said chamber axis, and means for pivotally supporting said rotor in said chamber including:

a longitudinal slot in the rotor, a key sliding in the slot and having a key axis parallel to the chamber axis and means attached to the key and engaging the outer body for causing the key axis to move along an orbital path around the chamber axis and at the same time rotate on the key axis, so that the rotor rotates on the rotor axis and the rotor axis moves around the chamber axis, whereby the rotor rotates continuously in one direction, closing successively with said walls six times with each revolution of the rotor on the rotor axis.

2. A rotary piston mechanism as in claim 1 wherein, the equilateral chamber triangle lies totally within said chamber, the rotor is generally symmetrical with respect to a plane through the length thereof parallel to the rotor axis, and the length of the rotor coincides with a side of the chamber equilateral triangle when the rotor closes with a wall of the chamber.

3. A rotary piston mechanism as in claim 2 wherein, the locus of the rotor axis about the chamber axis through one revolution of the rotor defines a three cusp hypocycloid figure, said figure having three equal curved sides which are concave with respect to the chamber axis.

4. A rotary piston mechanism as in claim 3 wherein, the width of the rotor is no greater than the distance from the chamber axis to a wall along a line perpendicular to said wall.

5. A rotary piston mechanism as in claim 4 wherein, the rotor rotates one-sixth of a revolution between successive closings with walls of the chamber.

6. A rotary piston mechanism as in claim 1 wherein, the rotation of the rotor with respect to the chamber is successively about axes located substantially at the corners of said chamber equilateral triangle.

7. A rotary piston mechanism as in claim 3 wherein, the rotation of the rotor on said rotor axis is opposite in sense to the movement of the rotor axis about the chamber axis.

8. A rotary piston mechanism as in claim 7 wherein, the movement of the rotor axis about the chamber axis cycles at a rate twice the rate of rotation of the rotor about the rotor axis.

9. A rotary piston mechanism as in claim 6 wherein, the portion of each of the chamber walls within the arc of an angle of said equilateral chamber triangle are of equal radius, the center of each of said arcs being the opposing points of the equilateral triangle.

10. A rotary piston mechanism as in claim 9 wherein, the angular length of each of said wall arcs centered at the opposing point of the equilateral triangle is substantially 60°.

11. A rotary piston mechanism as in claim 10 wherein, the corners of the chamber where two of the chamber walls meet define corner arcs of the chamber of equal radius less than the radius of said wall arcs.

12. A rotary piston mechanism as in claim 11 wherein, said corner arcs are each centered at the nearest point of the equilateral chamber triangle.

13. A rotary piston mechanism as in claim 1 wherein, said means attached to the key and engaging the outer body causes the key to rotate on its own axis, said key axis being parallel to the chamber axis and the sense of said orbital rotation of the key about the chamber axis with respect to the sense of rotation of the key on its own axis being opposite, and the rate of said orbital rotation to the rate of said key rotation on the key axis being 2:1.

14. A rotary piston mechanism for internal combustion engines, fluid motors, pumps and the like comprising, an outer body having means forming a chamber therein, a rotor confined in said chamber, said chamber having a chamber axis circumscribed by three equal curvilinear walls defining an equilateral chamber triangle in a plane perpendicular to the chamber axis, said three chamber walls being convex with respect to the chamber axis, said rotor being generally elongated, of length equal to the span of the chamber along the bisector of any angle of said equilateral triangle and having a rotor axis centrally located therein and parallel to said chamber axis, a longitudinal slot in the rotor, a key sliding in said slot, a shaft perpendicular to the plane of the chamber equilateral triangle, means rotatably bearing on the outer body for carrying said shaft in orbital rotation around the chamber axis, a sleeve rotatable on the shaft and fixedly attached to one end to the key, a sleeve gear fixedly attached to the other end of said sleeve, a gear stationary with respect to the outer body, and an orbiting gear combination meshing with said stationary gear and said sleeve gear, whereby the key orbits the chamber axis and rotates on its own axis, said rotations being in opposite sense and the orbital rotation rate being twice the axis rotation rate.

15. A rotary piston mechanism for internal combustion engines, fluid motors, pumps and the like comprising, an outer body having means forming a chamber therein, a rotor confined in said chamber, said chamber having a chamber axis circumscribed by three equal curvilinear walls defining an equilateral chamber triangle in a plane perpendicular to the chamber axis, said three chamber walls being convex with respect to the chamber axis, said rotor being generally elongated, of length equal to the span of the chamber along the bisector of any angle of said equilateral triangle and having a rotor axis centrally located therein and parallel to said chamber axis, and means for pivotally supporting said rotor in said chamber so that the rotor rotates on the rotor axis and the rotor axis moves around the chamber axis, including:

a rotor axle concentric with said rotor axis, an orbital gear fixedly attached to said rotor axle and having a gear axis parallel to and displaced from said rotor axis, means rotatably bearing on the outer body for carrying said orbital gear in orbital rotation around the chamber axis, and a gear stationary with respect to the chamber, said orbital gear meshing with said stationary gear, and the ratio of said orbital gear to said stationary gear being 1:3 whereby the rotor rotates continuously in one direction, closing successively with said walls six times with each revolution of the rotor on the rotor axis.

16. A rotary piston internal combustion engine comprising, an outer body having means forming a chamber therein, a rotor confined in said chamber, said chamber having a chamber axis circumscribed by three equal curvilinear walls defining an equilateral chamber triangle in a plane perpendicular to the chamber axis, said three chamber walls being convex with respect to the chamber axis, said rotor being generally elongated, of length equal to the span of the chamber along the bisector of any angle of said equilateral triangle and having a rotor axis centrally located therein and parallel to said chamber axis, and means for pivotally supporting said rotor in said chamber so that the rotor rotates on the rotor axis and the rotor axis moves around the chamber axis, whereby the rotor rotates continuously on one direction, closing successively with said walls six times with each revolution of the rotor on the rotor axis, sealing means at each end of the rotor which sealably engages a wall of the chamber at all times so that the chamber is divided into two portions, one increasing in volume and the other decreasing in volume as the rotor rotates, means for exhausting the larger of said chambers, means for feeding a combustible fluid mixture into the larger of said chambers, means for igniting said mixture in the chamber, means for closing the ends of the chamber along the chamber axis, and output drive at least one of said closing means being rotatable on the chamber axis and connected to said output drive, an exhaust housing encloses said closing means and fixedly connects to said outer body, said output drive fixedly connects to said rotatable closing means and is rotatably supported by said exhaust housing, said rotor is rotatable on said rotatable closing means, an exhaust housing gear is fixedly attached to the exhaust housing concentric with said chamber axis, and one or more rotor positioning gears carried by said rotatable closing means engage said rotor and mesh with said exhaust housing gear, whereby the mixture combusts producing gas which expands forcing said rotor to rotate and a mechanical output is engaged by the rotor and driven in rotation thereby.

17. A rotary piston internal combustion engine as in claim 16 wherein, exhaust ports are fixedly located in said exhaust housing, exhaust holes are located in said rotatable closing means, and said holes align with said ports to provide one or more exhaust fluid paths from the chamber through said exhaust housing.

18. A rotary piston internal combustion engine as in claim 17 wherein, an opening is provided through said other closing means for feeding said combustible mixture into the chamber.

19. A rotary piston internal combustion engine comprising, an outer body having means forming a chamber therein, a rotor confined in said chamber, said chamber having a chamber axis circumscribed by three equal curvilinear walls defining an equilateral chamber triangle in a plane perpendicular to the chamber axis, said three chamber walls being convex with respect to the chamber axis, said rotor being generally elongated, of length equal to the span of the chamber along the bisector of any angle of said equilateral triangle and having a rotor axis centrally located therein and parallel to said chamber axis, and means for pivotally supporting said rotor in said chamber so that the rotor rotates on the rotor axis and the rotor axis moves around the chamber axis, whereby the rotor rotates continuously in one direction, closing successively with said walls six times with each revolution of the rotor on the rotor axis, sealing means at each end of the rotor which sealably engages a wall of the chamber at all times so that the chamber is divided into two portions, one increasing in volume and the other decreasing in volume as the rotor rotates, means for closing the ends of the chamber along the chamber axis, rotatably carried by the outer body, one of said closing means is the exhaust closing means and the other is the intake closing means, an exhaust housing encloses said exhaust closing means and fixedly connects through the outer body, an output driveshaft on the chamber axis fixedly connected to said exhaust closing means and rotatably connected to said exhaust housing, the rotor is rotatably carried by the exhaust closing means, an exhaust housing gear is fixedly attached to the exhaust housing concentric with the chamber axis, one or more rotor positioning gears carried by the exhaust closing means engages the rotor and also meshes with the exhaust housing gear, an intake housing encloses said intake closing means and fixedly connects to said outer body, at least one intake port for conducting a combustible mixture through the intake housing and through the intake closing means into the chamber, and means for igniting said mixture in the chamber, whereby the mixture combusts producing gas which expands forcing the rotor to rotate driving said output shaft in rotation.

20. A rotary piston internal combustion engine as in claim 19 wherein, said exhaust holes and exhaust ports are displaced from the chamber axis, and said means for conducting the combustible mixture into the chamber includes an intake port concentric with the chamber axis.

21. A rotary piston fluid pump comprising, an outer body having means forming a chamber therein, a rotor confined in said chamber, said chamber having a chamber axis circumscribed by three equal curvilinear walls defining an equilateral chamber triangle in a plane perpendicular to the chamber axis, said three chamber walls being convex with respect to the chamber axis, said rotor being generally elongated, of length equal to the span of the chamber along the bisector of any angle of said equilateral triangle and having a rotor axis centrally located therein and parallel to said chamber axis, means for pivotally supporting said rotor in said chamber including:

a longitudinal slot in the rotor, a key sliding in the slot and having a key axis parallel to the chamber axis and means attached to the key and engaging the outer body for causing the key axis to move along an orbital path around the chamber axis and at the same time rotate on the key axis, so that the rotor rotates on the rotor axis and the rotor axis moves around the chamber axis, whereby the rotor rotates continuously in one direction, closing successively with said walls six times with each revolution of the rotor on the rotor axis, means providing a fluid intake passage to the chamber, means providing a fluid output passage from the chamber, and means for opening and closing said fluid passages in synchronism with the rotation of the rotor to compel fluid flow from the intake to the output passages.

22. A rotary piston mechanism for internal combustion engines, fluid motors, pumps and the like comprising, an outer body having means forming a chamber therein, a rotor confined in said chamber, said chamber having a chamber axis circumscribed by three equal curvilinear walls defining an equilateral chamber triangle in a plane perpendicular to the chamber axis, said three chamber walls being convex with respect to the chamber axis, said rotor being generally elongated, of length equal to the span of the chamber along the bisector of any angle of said equilateral triangle and having a rotor axis centrally located therein and parallel to said chamber axis, means for pivotally supporting said rotor in said chamber so that the rotor rotates on the rotor axis and the rotor axis moves around the chamber axis, sealing means at each end of the rotor which sealably engages a wall of the chamber at all times so that the chamber is divided into two portions, one increasing in volume and the other decreasing in volume as the rotor rotates, means for feeding fluid into one of said chamber portions, means for exhausting fluid from the other of said chamber portions, means for closing the ends of the chamber along the chamber axis, at least one of said closing means being rotatable on the chamber axis, a housing enclosing said closing means and fixedly connected to said outer body, a drive fixedly connected to said rotatable closing means and rotatably supported by said housing, said rotor being rotatable on said rotatable closing means, a housing gear fixedly attached to the housing concentric with said chamber axis, and one or more rotor positioning gears carried by said rotatable closing means engaging said rotor and meshing with said housing gear, whereby the rotor rotates continuously on one direction, closing successively with said walls six times with each revolution of the rotor on the rotor axis and fluid flows into and out of the chamber so that the mechanism performs as an internal combustion engine, fluid motor, pump or the like.

23. A rotary piston internal combustion engine as in claim 22 wherein, exhaust ports are fixedly located in said housing, exhaust holes are located in said rotatable closing means, and said holes align with said ports to provide one or more exhaust fluid paths from the chamber through said housing.

24. A rotary piston internal combustion engine as in claim 23 wherein, an opening is provided through said other closing means for feeding said fluid into the chamber.

* * * * *